US006000333A

United States Patent [19]

Davis

[11] Patent Number: 6,000,333

[45] Date of Patent: Dec. 14, 1999

[54] APPARATUS FOR USE IN A GRAVURE PRINTING PRESS

[75] Inventor: Edward McNeilage Davis, London, United Kingdom

[73] Assignee: Presstech Controls Limited, United Kingdom

[21] Appl. No.: 09/125,842

[22] PCT Filed: Feb. 12, 1997

[86] PCT No.: PCT/GB97/00374

§ 371 Date: Oct. 9, 1998

§ 102(e) Date: Oct. 9, 1998

[87] PCT Pub. No.: WO97/31777

PCT Pub. Date: Sep. 4, 1997

[30] Foreign Application Priority Data

Feb. 27, 1996 [GB] United Kingdom ..... 9604157

[51] Int. Cl.[6] ..... B41L 7/00; B41F 9/00; B41F 1/10; G03G 15/02

[52] U.S. Cl. ..... 101/132; 101/170; 101/153; 399/168; 399/115

[58] Field of Search ..... 101/132, 150, 101/153, 170, DIG. 37; 399/50, 100, 115, 136, 168, 169, 174–176; 361/225; 250/324; 346/153, 155

[56] References Cited

U.S. PATENT DOCUMENTS

| | | | |
|---|---|---|---|
| 4,440,082 | 4/1984 | Carey et al. | 101/170 |
| 4,494,857 | 1/1985 | Ueno et al. | 355/77 |
| 4,697,514 | 10/1987 | George et al. | 101/170 |
| 4,766,460 | 8/1988 | Yamamoto et al. | 355/4 |
| 4,958,563 | 9/1990 | Lewis et al. | 101/458 |

FOREIGN PATENT DOCUMENTS

| | | | |
|---|---|---|---|
| 0294042 | 12/1988 | European Pat. Off. | B41F 9/06 |
| 84/03068 | 8/1984 | WIPO | B41F 9/00 |

*Primary Examiner*—Kimberly L. Asher
*Attorney, Agent, or Firm*—Galgano & Burke

[57] ABSTRACT

Apparatus for use in a gravure press or other reproduction apparatus, comprising a roller apparatus which is at least partly electrically conductive and at least one electrical transfer device adjacent the surface of the roller and connected to a power source, in use, to enable a charge to be applied to the surface of the roller by each such transfer device, and means for moving the transfer device relative to the surface of the roller, in use, whereby to mitigate the adverse image-patterning effects on gravure printing, or other reproduction, of any spatial discontinuities in the level of charge transfer from the spaced transfer devices onto the roller.

18 Claims, 2 Drawing Sheets

APPARATUS FOR USE IN A GRAVURE PRINTING PRESS

DESCRIPTION OF THE PRIOR ART

This invention relates to gravure printing and in particular to apparatus for use in a gravure press and for a method of gravure printing. Our European Patent Application No. 88304242.6, published as EP-A-0294042, discloses an electrostatic assist (ESA) gravure press, as illustrated in FIGS. 1 and 2 of the accompanying drawings, in which laterally spaced electrical contacts, contacting the surface of the impression roller, are used to supply an electric charge to the surface of the impression roller. Each of the electrical contacts comprises a multiplicity of deflectable electrically-conductive filaments, made for example from stainless steel. This represented an improvement on the arrangement previously disclosed in WO84/03068, in which there were laterally spaced stainless steel wiper blades, urged under spring action against the impression roller surface, instead of the bristles or other filaments, because there was less wear on the impression roller, and there was a lower build up of dust on the impression roller.

Such electrostatic assist systems apply an electric field across the nip of a gravure press unit, between the impression roller and the print cylinder. This electric field assists the transfer of the ink from the cylinder cells to the web. The impression roller has a conductive surface which is insulated from the roller core, and hence from the printing unit. The surface resistivity of the impression roller is critical in the successful implementation of the electrostatic assist system. A power supply is connected to the charge transfer mechanism, i.e. to the electrical contacts in the case of the system described in our European Patent Application No. EP-A-0294042 referred to above. It is this transfer of charge which raises the potential of the roller surface to a voltage suitable to produce and to maintain the necessary electric field at the nip. By suitable control of the power supply, the magnitude of the nip electric field can be controlled.

The impression roller in the printing press acquires a coating of the various contaminants, visible and invisible, present in such an environment. Among these could be dust from the paper and the ink and their constituents and from other sources. The roller surface can be permanently affected by such contamination and need re-grinding or similar processing to return it to its original condition.

The effect of this contaminant when no ESA printing is being done is negligible as the contamination tends to be evenly deposited over the roller surface and the impression roller pressure (the main influence on non-ESA print) is negligibly affected.

The application of ESA to a suitable impression roller contaminated as above would, again, be minimal. The slight variation in roller surface conductivity is easily compensated for in the ESA control system electronics.

This all assumes that the contamination is even over the surface. When this condition is not maintained a "pattern" may build up on the surface. Patterning on the surface of the impression roller is due to a non-uniform charge being applied to the surface as well as, in the case of a contact charge system, non-uniformity of the charge transfer contacts themselves. Again the non-ESA impression roller print is largely unaffected. Only when the contamination is particularly bad does this pattern transfer to the print.

However, because of this effect, ESA roller conductivity will vary locally across the surface corresponding with the pattern. As a result, when the ESA system is switched on, the ESA effect will vary locally across the roller surface reflecting the variation in roller surface conductivity. The effect of this is to induce, in the areas of greater or lesser ESA transfer, a developed pattern on the printed material.

In an ESA system the charge transfer mechanism itself contributes to the patterning on the roller surface, the resulting pattern reflecting discontinuities and unevenness in the charge transfer process.

OBJECTS OF THE INVENTION

Accordingly, the purpose of the present invention is to mitigate the problems with existing electrostatic assist mechanisms, and we have discovered that this can be achieved by moving mechanically the charge transfer mechanism relative to the surface of the impression roller. Thus the invention provides apparatus for use in a gravure press or other reproduction apparatus, comprising a roller apparatus which is at least partly electrically conductive and at least one electrical transfer device adjacent the surface of the roller and connected to a power source, in use, to enable a charge to be applied to the surface of the roller by each such transfer device, and means for moving the transfer device relative to the surface of the roller, in use, whereby to mitigate the adverse image-patterning effects on gravure printing, or other reproduction, of any spatial discontinuities in the level of charge transfer from the spaced transfer devices onto the roller.

The invention also provides a method of reproduction, such as by gravure printing, including applying an electric charge to the roller surface of the reproduction apparatus, such as the impression roller surface of a gravure printing press, using at least one electrical transfer device arranged adjacent the roller surface, whilst moving the transfer device, whereby to mitigate the adverse image-patterning effects on gravure printing of any spatial discontinuities in the level of charge transfer from the spaced transfer devices onto the roller.

The movement of the charge transfer mechanism, preferably in a cyclic manner, evens out the contamination settling on the roller surface, and prevents any charge transfer devices taking on a "set", i.e. a particular orientational or positional bias different from that which it is intended to adopt.

The purpose is to provide sufficient movement to even out any repeated patterning discontinuities across the roller width. To achieve this, an appropriate time period and amplitude of cyclic movement may be used.

Whilst the primary purpose of the invention is to even out the contamination across the surface of the roller which would otherwise subject the printing process to a varying electrostatic assist, removing the pattern from the printed material, a further purpose is to remove some of the contamination build up. This is because the motion of the charge transfer devices can dislodge contaminant particles.

BRIEF DESCRIPTION OF THE DRAWINGS

In order that the invention may be better understood, a preferred embodiment will now be described, by way of example only, with reference to the accompanying drawings, in which.

Figure 1:
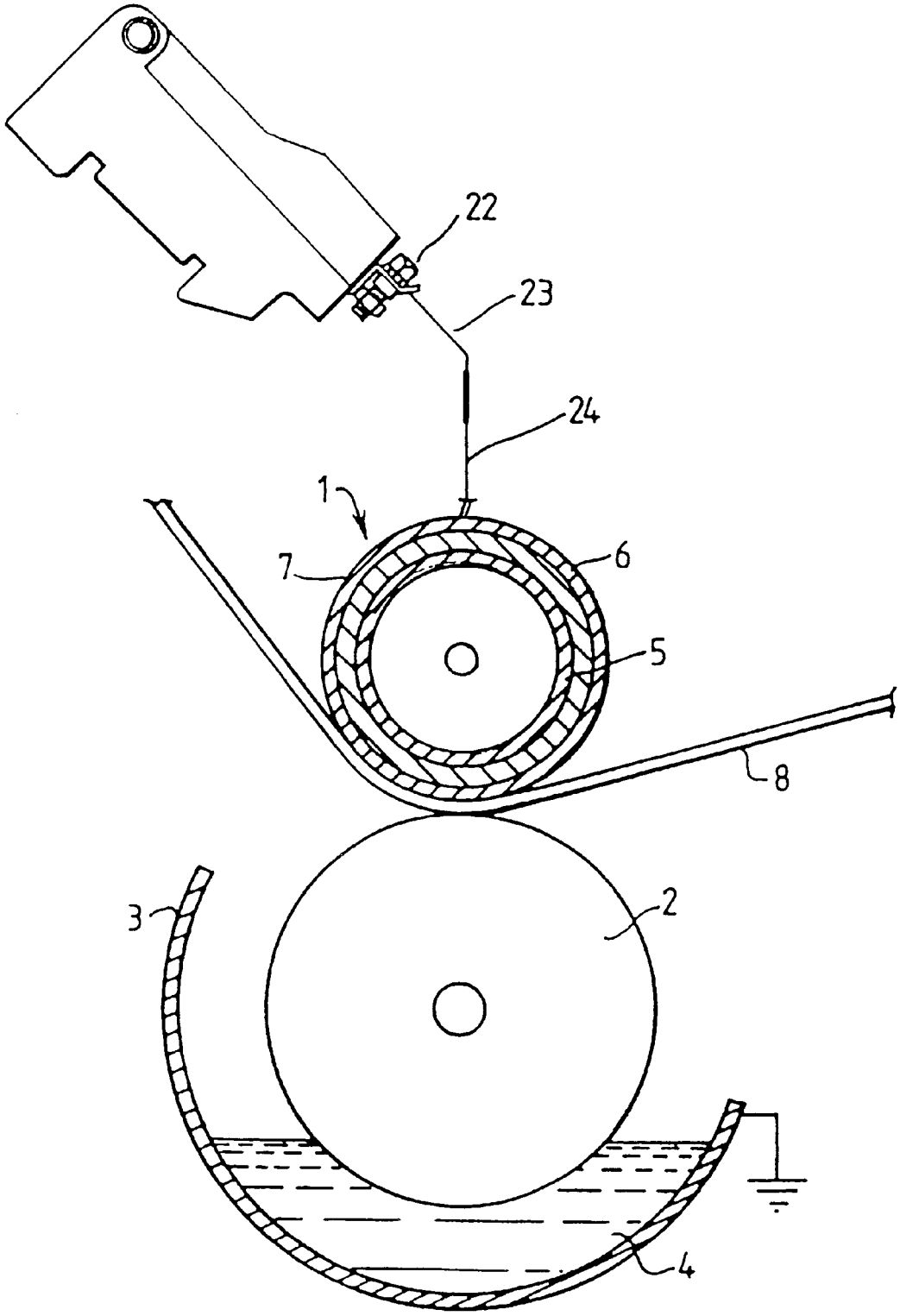
FIG. 1 (PRIOR ART)
FIGS. 1 and 2 are respectively a side elevation and a plan of an electrostatic assist gravure press including a direct charging system, as disclosed in our prior art European Patent Application No. EP-A-0294042 referred to above.

To explain the context of the present invention, the known system described in our European Patent Application No. EP-A-0294042 will now be described briefly, with reference to FIGS. 1 and 2.

An impression roller 1 is positioned adjacent, and in contact with, a gravure cylinder 2, and an ink fountain 3 is arranged concentrically with the gravure cylinder 2 to supply ink 4 to its surface as it rotates. The impression roller 1 includes a hollow metal core 5, an intermediate rubber insulating layer 6 and an outer semiconducting layer 7. The metal core 5 is electrically earthed, and the impression roller 1 typically has a maximum current leakage of 0.2 milliamperes at 4,000 volts. The intermediate insulating layer 6 is approximately 3–5 mm thick and covers the length of the core 5. The semiconducting layer 7 is only moderately conductive and is approximately 8–13 mm thick. The resistivity of the semiconducting layer 7 is preferably approximately $2\times10^7$ ohm cm. Further details of the electrostatic assist arrangement including press and ink parameters may be obtained from the "Electrostatic Assist Manual" published by Gravure Research Institute, Inc. of Port Washington, N.Y., in 1981.

A web 8 is pressed in the nip between the impression roller 1 and the rotating gravure cylinder 2, and ink is transferred from the gravure cells of the gravure cylinder 2 to the web 8.

Electrical connection from the power supply unit is to a first charge transfer module 11 of a row of charge transfer modules 11–16, parallel to the roller axis. Each module is connected electrically by means of a connecting strip 17 and each makes an electrical connection to its blade holder 22 and blade 23 fitted to the module lid.

At the end of each blade 23 is attached a group of flexible filaments or bristles 24 typically 18 mm long. In this example, the distance between each adjacent pair of blades 11–18 is from 3 to 10 mm.

When the lid of a charge transfer module is lowered to the operating position, electrical contact is made to the blade holder 22. When the lid is raised to the non-operative position, electrical contact to the blade is broken. This permits the selection of operational modules to match, approximately, the width and position of the web 8.

The charge coupling system for the electrostatic assist includes a supporting cross-member 10 which mechanically supports the charge transfer modules. In this example six charge transfer modules 11–16 are screwed to the supporting cross member.

Figure 2:
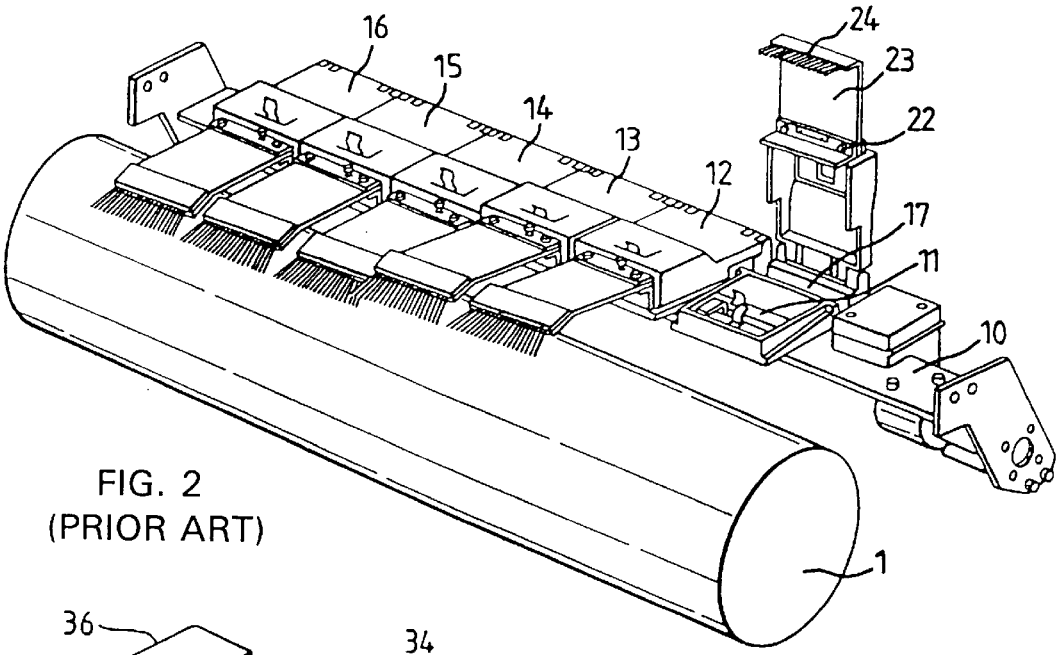
FIG. 2 (PRIOR ART)

The free ends of the filaments contact the surface of the impression roller 1 when the blades are in their operative position as shown in FIG. 1. The filaments 24 are pressed against the impression roller 1 by adjusting the position of the supporting cross-member 10 relative to the impression roller 1. This maintains good electrical contact with the surface of the impression roller 1 whilst it is rotating. Thus the filaments 24 are deflected slightly in the tangential direction with respect to the impression roller 1. However, since the filaments are flexible, they cause little wear on the surface.

DETAILED DESCRIPTION OF THE INVENTION

Figure 3:
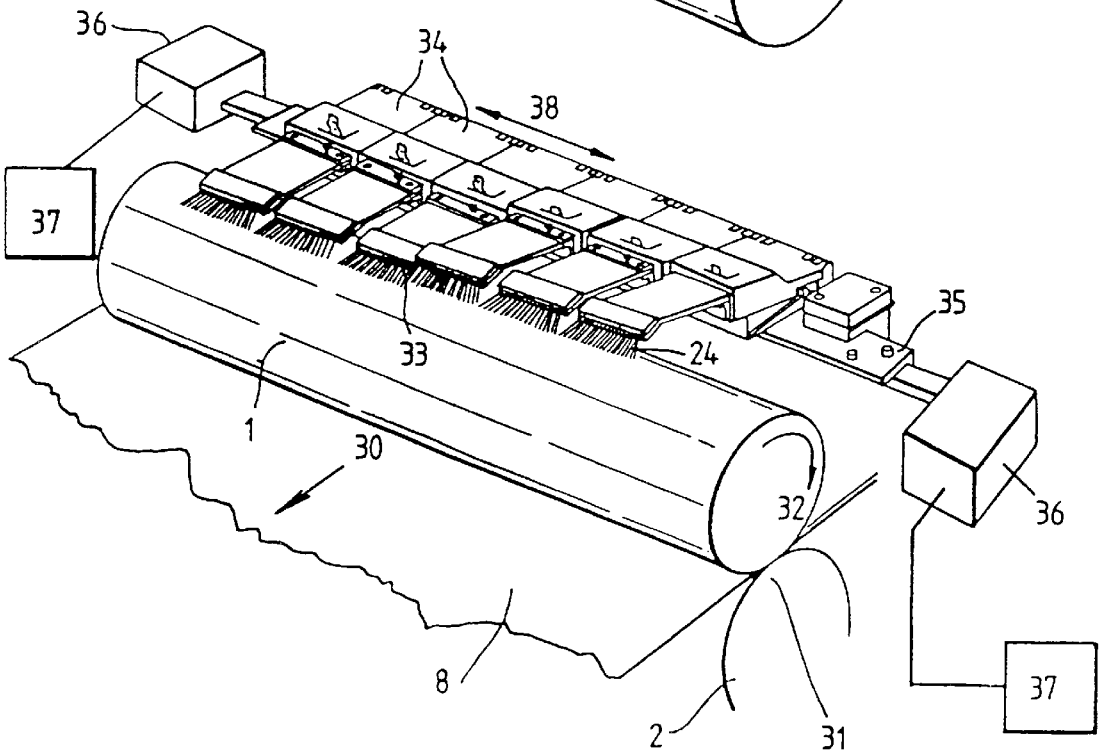
FIG. 3 is a schematic perspective view of part of a gravure printing press embodying the invention.

The embodiment of the invention shown in FIG. 3 uses a similar electrostatic assist system, but additionally incorporates an arrangement for moving the charge transfer devices whilst the rollers are rotating in use. Elements of the apparatus in FIG. 3 which correspond to the apparatus of FIGS. 1 and 2 are given the same reference numeral.

As the print cylinder 2 rotates, and the web 8 moves longitudinally in the direction 30, the impression roller 1 rotates in the direction 32 as shown. Electrostatic assist is provided by six charge transfer mechanisms 34 all connected to a common charge transfer bar 35 which is connected electrically to a power supply (not shown).

In FIG. 3, the three charge transfer mechanisms 34 on the left-hand side are shown pivoted downwardly into contact with the impression roller surface, whereas the other three charge transfer mechanisms, on the right-hand side, are shown pivotally raised so as to be out of contact. The radial position is thereby adjustable, and is intended to be set before a print run.

An hydraulic drive arrangement for the charge transfer bar 35 comprises a drive mechanism 36 at each end of the charge transfer bar 35, and controlled by movement control units 37.

In the arrangement shown in FIG. 3, the pneumatic drive causes a simple reciprocating transverse motion of the bar 35, in the direction shown at 38, in a plane tangential to the surface of the impression roller 1. Again in this example, the motion is simple harmonic, but of course alternatives would be possible. The speed of the stroke is governed by an adjustable restrictor in the air cylinders of the pneumatic drive (not shown). Increasing or reducing the air flow provides a corresponding increase or reduction in the speed of movement of the assembly of charge transfer mechanisms 34. The duration of each stroke is governed by an adjustable timer relay (not shown): increasing the duration will lengthen the amplitude of the stroke. Thus the magnitude of the stroke is governed by both the speed and the duration settings, and these are programmable on site to suit the particular requirements.

It will be apparent to the skilled reader that the motion of the charge transfer mechanisms 34 could be controlled in a number of different ways. Indeed, they are not necessarily moved in tandem, and each mechanism 34 could be moved by its own drive mechanism. Whilst the motion could be random, a regular cyclic motion is preferred. In one example, the motion of the bar 35 is a two-dimensional cyclic motion, elliptical in path, in the tangential plane. This can typically be achieved by providing a further arrangement of hydraulic drives (not shown), transverse to the drives 36.

Further, the radial position of the charge transfer mechanisms 34 can be varied, in relation to the impression roller 1, i.e. vertically in FIG. 3, either randomly or with a periodic motion. Where the bristles or other filaments 24 are in contact with the impression roller surface, the radial motion would vary the pressure applied. Such radial motion could be combined with tangential motion in one or two dimensions.

In the case of the simple harmonic motion in one line 38 illustrated in FIG. 3 the amplitude would typically be 20 mm and the period would typically be 2 seconds. The amplitude and speed are variable to provide motion ranging from a long sweeping motion to a short vibratory motion. The amplitude might be between 10 and 30 mm, and the period between 0.5 second and 3 seconds. This variation could indeed be programmed to occur in use during the rotation of the roller 1, to enhance the evening out effect provided in accordance with the invention.

Whilst the invention is preferably embodied in an electrostatic assist mechanism incorporating filaments such as shown at 24 in FIG. 3, a similar principle could be used in relation to the strip contacts of the type disclosed in WO84/03068, for example.

The invention could conceivably be embodied in a non-contact system using e.g. corona discharge electrodes spaced radially from the roller surface 1, the electrodes being made to oscillate in a tangential plane or close to such a plane.

I claim:

1. Apparatus for use in a gravure press or other reproduction apparatus, comprising a roller apparatus which is at least partly electrically conductive and at least one electrical transfer device adjacent the surface of the roller and connected to a power source, in use, to enable a charge to be applied to the surface of the roller by each such transfer device, and means for moving the transfer device relative to the surface of the roller, in use, whereby to mitigate the adverse image-patterning effects on gravure printing, or other reproduction, of any spatial discontinuities in the level of charge transfer from the spaced transfer devices onto the roller.

2. Apparatus according to claim 1, in which the roller is the impression roller of a gravure printing press.

3. Apparatus according to claim 1, in which there is a plurality of spaced electrical transfer devices.

4. Apparatus according to claim 3, in which the transfer devices are all connected to a transport body and the moving means is arranged to move the transport body continuously in use.

5. Apparatus according to claim 3 thereon, in which the transfer devices are disposed in a line parallel to the axis of the roller.

6. Apparatus according to claim 1, in which the moving means is adapted to move the transfer device or devices continuously.

7. Apparatus according to claim 1, in which the or each transfer device comprises a multiplicity of deflectable, electrically-conductive filaments.

8. Apparatus according claim 1, in which the moving means is arranged to move the transfer device or devices in a plane tangential to the surface of the roller.

9. Apparatus according to claim 8, in which the moving means is arranged to move the transfer devices in a reciprocating path axially of the roller.

10. Apparatus according to claim 8, in which the moving means is arranged to move the transfer devices in a two-dimensional path in the tangential plane.

11. Apparatus according to claim 1, in which the moving means is arranged to move the transfer device or devices at least partly in a radial direction with respect to the roller.

12. Apparatus according to claim 1, in which the motion of the transfer device or devices is a repeated and periodic motion.

13. Apparatus according to claim 12, comprising means for varying the amplitude of the periodic motion.

14. Apparatus according to claim 12, comprising means for varying the speed or frequency of the periodic motion.

15. Apparatus according to claim 1, in which the transfer devices are spaced radially from the roller.

16. Apparatus according to claim 1, in which the transfer device or devices are arranged to be in continuous electrical contact with the roller surface.

17. A method of reproduction, such as by gravure printing, including applying an electric charge to the roller surface of the reproduction apparatus, such as the impression roller surface of a gravure printing press, using at least one electrical transfer device arranged adjacent the roller surface, whilst moving the transfer device, whereby to mitigate the adverse image-patterning effects on gravure printing of any spatial discontinuities in the level of charge transfer from the spaced transfer devices onto the roller.

18. A gravure printing press incorporating apparatus according to claim 1.

* * * * *